US006036530A

United States Patent [19]

Edwards et al.

[11] Patent Number: 6,036,530

[45] Date of Patent: Mar. 14, 2000

[54] MODULAR FEED-THROUGH CONNECTOR AND MOUNTING ASSEMBLY FOR TANK HEATER

[75] Inventors: Gary C. Edwards; Kelly F. Olischefski, both of Winnipeg, Canada

[73] Assignee: Phillips & Temro Industries Ltd., Canada

[21] Appl. No.: 08/851,783

[22] Filed: May 6, 1997

[51] Int. Cl.[7] ..... H01R 13/58

[52] U.S. Cl. ..... 439/455; 439/926; 174/153 G

[58] Field of Search ..... 439/556, 559, 439/926, 281, 282, 453, 376, 275, 34, 455; 174/153 G, 52.3

[56] References Cited

U.S. PATENT DOCUMENTS

| | | | |
|---|---|---|---|
| 2,275,762 | 3/1942 | Horton | 439/281 |
| 2,324,791 | 7/1943 | McLoughlin | 174/153 G |
| 2,756,402 | 7/1956 | Haworth | 439/455 |
| 2,945,203 | 7/1960 | Quackenbush | 439/453 |
| 3,157,450 | 11/1964 | Harrison | 439/281 |
| 3,429,890 | 2/1969 | Guttmann | 174/52.3 |
| 3,611,255 | 10/1971 | Shroyer | 439/282 |
| 5,078,615 | 1/1992 | Benson | 439/376 |
| 5,588,858 | 12/1996 | Lester | 439/275 |
| 5,626,486 | 5/1997 | Shelly | 439/281 |
| 5,669,763 | 9/1997 | Pryce | 439/34 |

OTHER PUBLICATIONS

Kim Hotstart Mfg. Co., Inc., brochure entitled "Heavy Duty Truck Engine Pre–Heaters And Accessories", 24 pages, No date.

DEFA, advertising literature, 1996 *Automechanica*, 2 pages, No date.

DEFA, advertising literature, 1996 *Automechanica*, 2 pages, No date.

DEFA, advertising literature, dated May 18, 1995, 3 pages, No date.

DEFA, advertising literature, undated, 5 pages, No date.

Calix, advertising literature, undated, 2 pages, No date.

Calix assembly instructions, undated, 3 pages, No date.

ADAX, advertising literature, 1 page, No date.

Photographs of the Calix engine heater, No date.

Photographs of the DEFA tank heater, No date.

*Primary Examiner*—Neil Abrams
*Assistant Examiner*—Javaid Nasri
*Attorney, Agent, or Firm*—Harness, Dickey & Pierce, P.L.C.

[57] ABSTRACT

A modular tank heater apparatus including a housing defining a cavity and a receptacle that is in communication with the cavity, a heater element coupled to the housing, and a set of cords selectively connectable to the heater element to provide either a permanent or releasable electrical connection. Each of the set of cords includes a plug with a generic portion and a specific portion. The generic portion of the plugs are selectively disposable in the receptacle to engage the housing and create a first seal between the plug and the housing. Additionally, the plugs define a seal surface engageable with the housing to create a second seal between the plug and the housing. The present invention also provides a method of manufacturing the modular tank heater. Finally, the present invention includes a tank heater having a mounting assembly for selectively connecting the housing to a body in a variety of positions. The mounting assembly includes a plurality of mounting elements integral with the housing, a first bracket and a second bracket each having a first end and a second end, and coupling means for selectively coupling the first end of the first bracket to one of the plurality of mounting elements, the second end of the first bracket to a body, the first end of the second bracket to another one of the plurality of mounting elements, and the second end of the second bracket to the body.

20 Claims, 5 Drawing Sheets

MODULAR FEED-THROUGH CONNECTOR AND MOUNTING ASSEMBLY FOR TANK HEATER

BACKGROUND OF THE INVENTION

1. Technical Field

This invention generally relates to electrical connectors and, more particularly, to a modular electrical connection assembly and mounting apparatus for a tank heater.

2. Discussion

Tank style electric heaters are used to heat the coolant fluid in an internal combustion engine during cold weather operation in order to aid in startability and decrease the warming time for the engine. The heaters are commonly sold for use with a variety of engine powered goods and are marketed throughout the world. For example, tank heaters are manufactured for use in the automotive aftermarket, in heavy duty markets for installation by fleet operators and licensed mechanics on large trucks, agricultural equipment, and construction vehicles, as well as in industrial markets for use with equipment such as generators. Each of the many tank heater applications have design characteristics commonly requiring tailoring of the unit either for the particular use or the geographic market in which the unit is distributed.

For example, in the automotive aftermarket, installation on cars and light trucks typically performed by garages and home mechanics, demands inexpensive throw-away type products. Tank heaters for these applications are therefore produced with a permanent, nonreplaceable, and fixed length type power cord. Conversely, in the heavy duty market, including original equipment manufacturers, customers demand a tank heater product that is more flexible in application so as to allow different routing paths of the power cord through the engine compartment. As a result, power cords that are permanently mounted to the tank heater body require the dealer/manufacturer or distributor to stock a large quantity of unique tank heater/power cord combinations thus increasing the investment in inventory.

The unique demands of the automotive, heavy duty, and industrial markets is further illustrated by the preferred connection to the power source. In industrial applications, the power source is typically supplied without a male end termination for direct wiring to the power source. Further, a double insulated (round-type) power cord is typically supplied for industrial market demands. Conversely, the automotive and heavy duty aftermarkets do not generally require direct wiring to the power source nor the double insulated power cord in all applications. Presently, manufacturers separately produce different tank and cord set configurations for the permanent and removable applications thereby increasing the overall cost of production.

Further cost concerns arise due to international distribution of a particular tank heater. Many international markets have electrical requirements different than those in North America. For example, heaters manufactured for Europe operate on 230 volts of alternating current (Vac) whereas heaters for use in North America are designed for 120 and 240 Vac. Again, different tank heaters and cord sets are commonly manufactured specifically for use in one of these national markets.

The many tank heater markets and applications make it desirable for tank heaters to have a mounting assembly that allows placement of the heater in a variety of positions relative to the engine. In this regard, it is desirable to maximize the mounting flexibility of the tank heater while maintaining structural strength as well as ease of installation and removal. Tank heater mounting flexibility is important not only for efficiency and convenience but also because it is critical to proper heater operation that the unit be mounted low in the coolant system.

In view of the above, the modular connector described herein provides a detachable power cord allowing dealers or distributors to stock a variety of different wattages or voltages of tank heaters and several different lengths of power cords in order to mix and match these components as required. Further, the modular connector allows the molding of a strain relief around a different wire diameter while containing the outside strain relief dimensions within the same mating components. Finally, the combination of the modular connector and the mounting assembly of the present invention maximizes the overall flexibility of use for the tank heater.

SUMMARY OF THE INVENTION

The present invention provides a modular connector and mounting assembly for use with electrically powered equipment and, more particularly, with electric tank heaters. The modular tank heater apparatus includes a housing defining a cavity and a receptacle that is in communication with the cavity, a heater element coupled to the housing, and a set of cords selectively connectable to the heater element for communicating an electric current thereto. The set of cords includes a first cord and a second cord each of which have a plug with a generic portion and a specific portion. The generic portion of the plugs are selectively disposable in the receptacle to engage the housing and create a first seal between the plug and the housing. Additionally, the plugs define a seal surface engageable with the housing to create a second seal between the plug and the housing. Finally, each of the cords include a conducting means extending through the plug that is connectable to the heater element for communicating an electric current thereto.

The present invention also provides a method of manufacturing a modular tank heater including the steps of manufacturing a housing that includes a cavity and a receptacle communicating with the cavity, coupling an electric heating element to the housing, and manufacturing a first cord set and a second cord set which each include a plug disposable in the receptacle to create a first seal and a second seal between the plug and the housing.

Finally, the present invention includes a tank heater having a housing, a heating element coupled to the housing, conducting means for electrically connecting the heating element to a power source, and a mounting assembly for selectively connecting the housing to a body in a variety of positions. The mounting assembly includes a plurality of mounting elements integral with the housing, a first bracket and a second bracket each having a first end and a second end, and coupling means for selectively coupling the first end of the first bracket to one of the plurality of mounting elements, the second end of the first bracket to a body, the first end of the second bracket to another one of the plurality of mounting elements, and the second end of the second bracket to the body.

BRIEF DESCRIPTION OF THE DRAWINGS

Other objects and advantages of the invention will become apparent upon reading the following detailed description and upon reference to the drawings, in which.

DETAILED DESCRIPTION

The following description of the preferred embodiments of the present invention is merely exemplary in nature and is not intended to limit the scope of the claimed invention. Moreover, the following description, while depicting the invention in an environment specifically relating to tank heaters, is intended to adequately teach one skilled in the art to make and use the modular electrical connector apparatus and method, as well as the mounting assembly, described herein in a variety of electrical assemblies.

Figure 1:
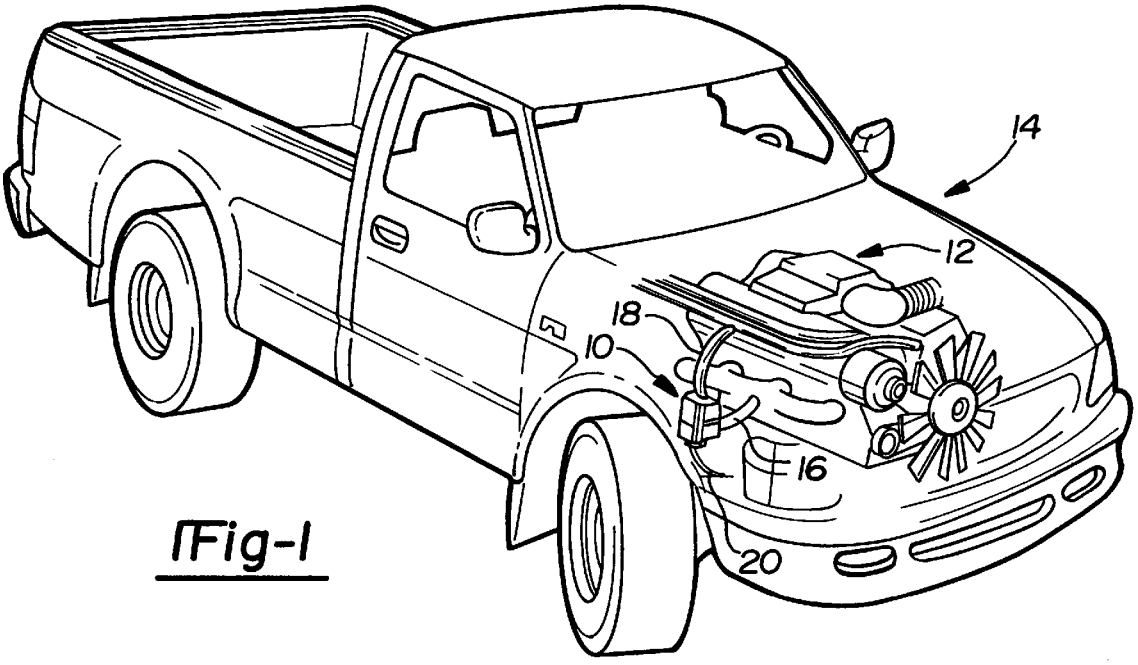
FIG. 1 is a perspective view of a light duty truck showing an exemplary location of a tank heater relative to an engine.

FIG. 1 illustrates a tank heater 10 coupled to an interior combustion engine 12 of a motor vehicle 14. Tank heater 10 increases the temperature of a fluid such as an engine coolant so as to enhance the cold weather startability and operation of engine 12. Tank heater 10 is in fluid communication with engine 12 through an input hose 16 and an output conduit 18 and includes a power cord set 20 for electrically connecting tank heater 10 to a power source 19 (FIG. 2).

As will be apparent from the following description and the appended drawings, tank heater 10 of the present invention includes a body 21 (FIG. 2) that may be used for tank heater applications in the automotive aftermarket as well as heavy duty and industrial markets in North America, Europe, and other countries. Body 21 is usable in these various markets and geographic regions due to a modular electrical connection including a receptacle that is cooperative with a variety of cord sets 20 having a generic plug portion. The flexibility provided by tank heater 10 is further enhanced by a mounting assembly 23 that allows the tank body 21 to be easily and firmly positioned in a variety of locations relative to engine 12.

Figure 2:
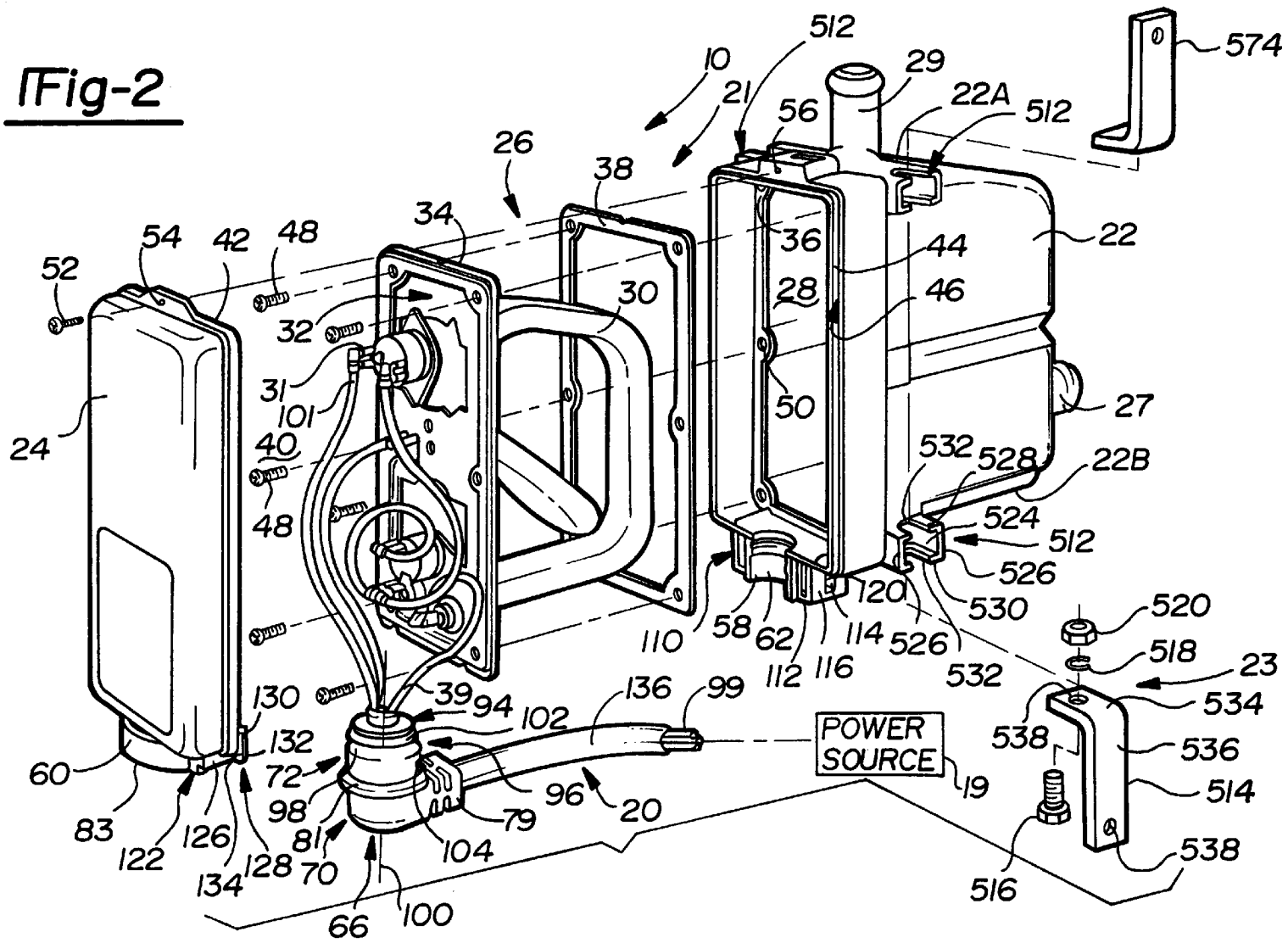
FIG. 2 is an exploded perspective view of the tank heater shown in FIG. 1.

Tank heater 10 is illustrated in FIG. 2 to include cord set 20, body 21, and mounting assembly 23 wherein body 21 includes a basin 22, a terminal cap 24, and a coil assembly 26. Coil assembly 26 is disposed within a cavity 28 defined by basin 22 and includes an electrically resistant heating element 30 coupled to a plate 32 that has a first face 34 cooperative with a seal face 36 on basin 22. A seal is provided in a manner known in the art between plate 32 and basin 22 such as by a gasket 38 compressibly secured between first face 34 and seal face 36. In operation, fluid is communicated into and through cavity 28 via input hose 16 (FIG. 1) being coupled to an input nipple 27 and output conduit 18 (FIG. 1) being coupled to an output nipple 29.

Coil assembly 26 defines a plurality of electrical connections 31 that are positioned about plate 32, configured to communicate with coil 30, and electrically connectable to lead wires 39 of cord set 20 in a manner generally known in the art. Electrical connections 31 are generally located within a connection chamber 40 (FIG. 5) defined between plate 32 and terminal cap 24. The integrity of the electrical connections between lead wires 39 and heating element 30 is generally protected by a seal that is created when cap 24 is mated to basin 22. Specifically, cap 24 has a groove (not shown) running around the perimeter of a seal face 42. The groove is cooperative with a rib 44 located along a seal face 46 of basin 22. As illustrated in FIG. 2, the seal between plate 32 and basin 22 is effected through mechanical connections known in the art such as screws 48 engaging internally threaded bores 50 in basin 22. In a similar fashion, the seal between cap 24 and basin 22 is held in place via screw 52 disposed through terminal cap aperture 54 to engage an internally threaded bore 56 in basin 22 as well as a coupling assembly that includes locking housings 108 and 110 and tabs 122 and 124 as hereinafter described (FIGS. 2–4).

Basin 22 and terminal cap 24 each define sleeve segments 58 and 60, respectively, (FIGS. 2–5) that cooperate to define a receptacle 62 communicating with connection chamber 40. Those skilled in the art will appreciate from the following description that receptacle 62 and a plug 66 of cord set 20 cooperate to effectively seal chamber 40 from the environment surrounding tank heater 10. In the preferred embodiment of the present invention, connection chamber 40 is sealed by a double seal arrangement including an inner seal 64 and an outer seal 68 as hereinafter described with reference to FIG. 5.

Figure 3:
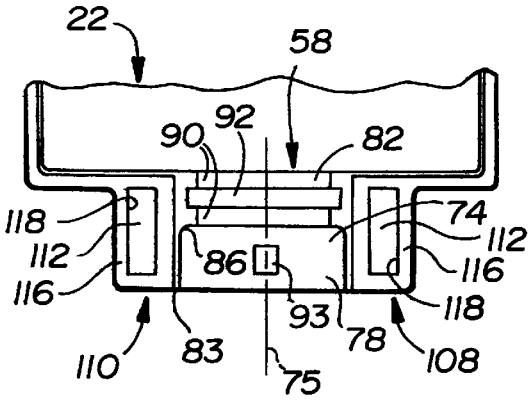
FIG. 3 is a partial elevational view of the tank basin shown in FIG. 2 illustrating the receptacle portion thereof.
Figure 4:
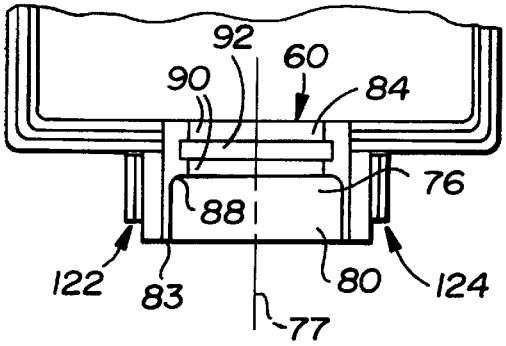
FIG. 4 is a partial elevational view of the tank heater terminal cap illustrating the receptacle portion thereof.

The respective sleeve segments 58 and 60 defining receptacle 62 are illustrated in FIGS. 3 and 4, respectively, to include interior surfaces 74 and 76, respectively, that are sealably cooperative with a generic portion 72 of plug 66 as hereinafter described with reference to FIG. 5. Sleeve segments 58 and 60 are illustrated in the preferred embodiment of the present invention as being generally semicircular in section and formed about axes 75 and 77, respectively, (FIGS. 3 and 4) to include enlarged diameter portions 78 and 80 and reduced diameter portions 82 and 84 interconnected by tapered portions 86 and 88, respectively. Reduced diameter portions 82 and 84 each define radial faces 90 and a groove 92 extending radially outwardly therefrom. Finally, an index tab 93 extends radially inwardly from interior surface 74 within enlarged diameter portion 78 of sleeve segment 58. As is described in detail hereinafter, tab 93 cooperates with a slot formed in the generic plug portion of each modular cord set to properly orient the plug within receptacle 62. Those skilled in the art will appreciate from the entirety of this description as well as the appended claims and drawings, that the specific configuration of sleeve segments 58 and 60 may be varied to cooperate with various plug geometries.

Figure 5:
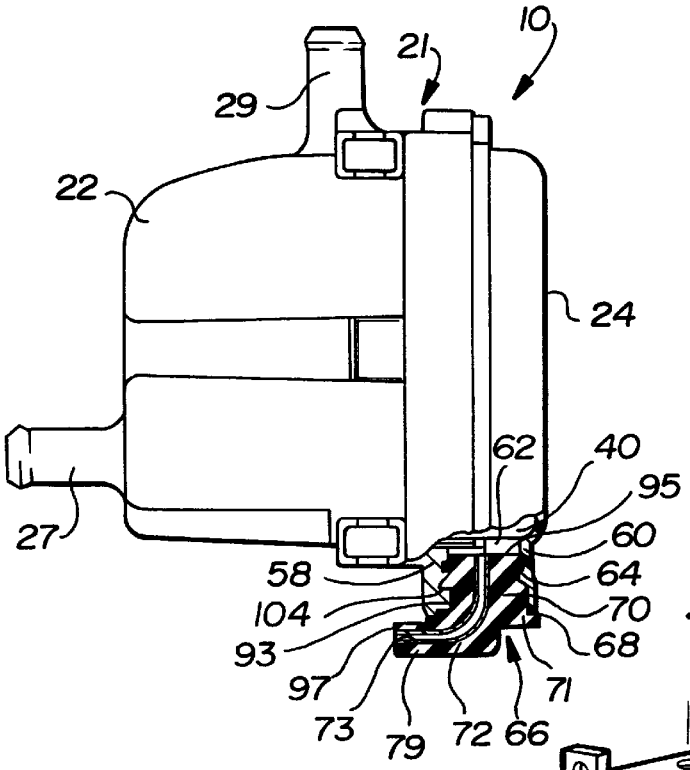
FIG. 5 is a side elevational and partial sectional view of an assembled tank heater such as that shown in FIG. 2.
Figure 6:
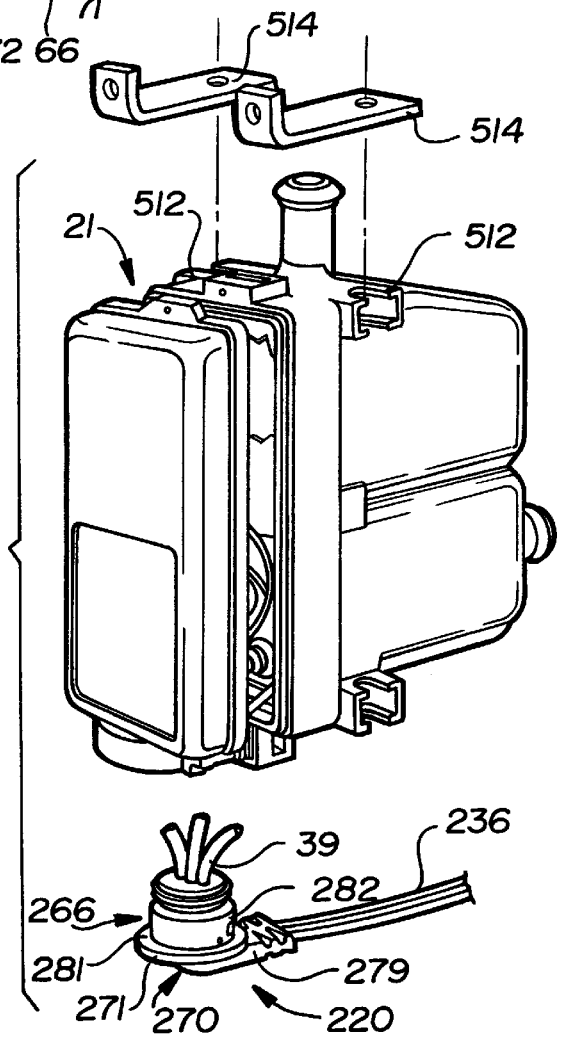
FIG. 6 is a partially exploded perspective view of a tank heater similar to that shown in FIG. 2 illustrating another embodiment of a cord set for electrically connecting the heater element to a power source.
Figure 7:
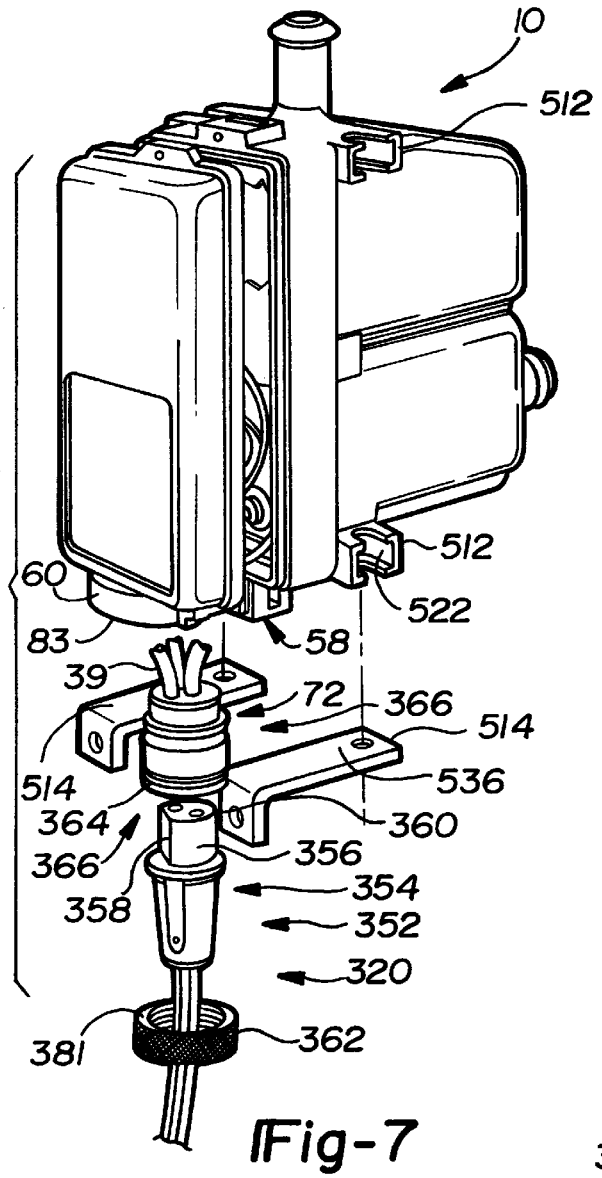
FIG. 7 is a partially exploded perspective view of the tank heater including an adapter for removably coupling a cord set to the heater.
Figure 8:
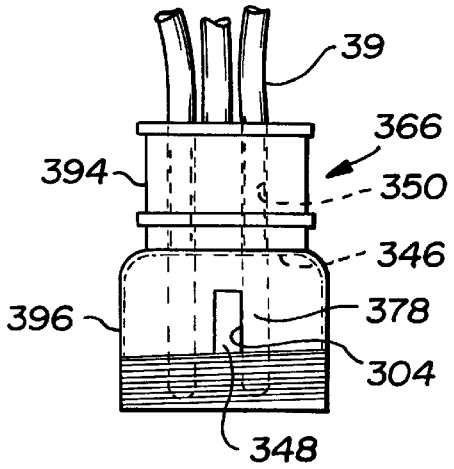
FIG. 8 is a side elevational view of the adapter shown in FIG. 7.
Figure 9:
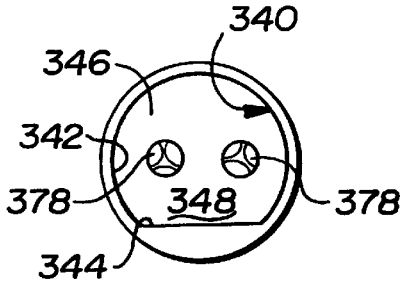
FIG. 9 is a bottom plan view of the adapter shown in FIG. 8.
Figure 10:
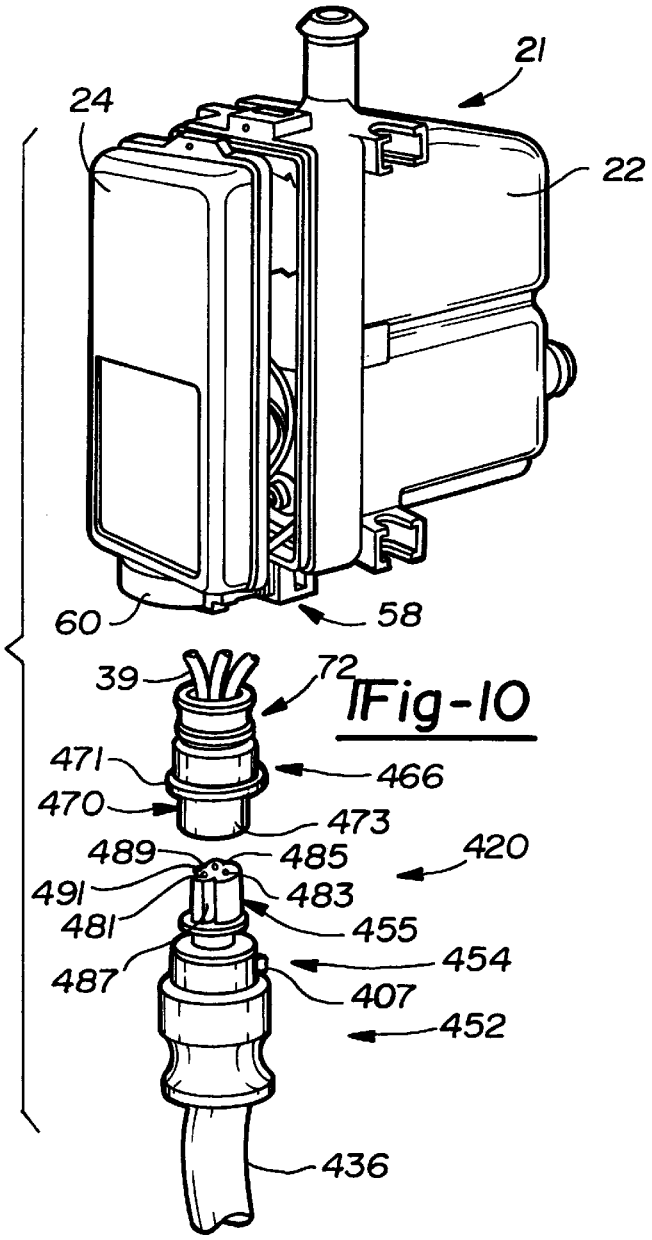
FIG. 10 is a partially exploded perspective view of a tank heater including an adapter for the European market.
Figure 11:
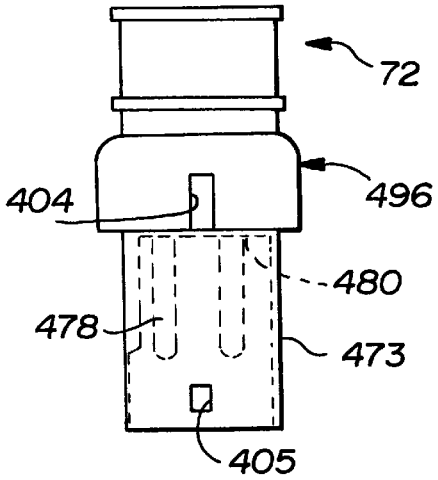
FIG. 11 is a side elevational view of the adapter shown in FIG. 10.
Figure 12:
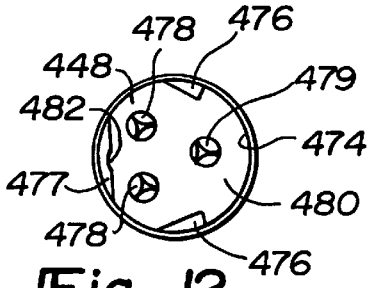
FIG. 12 is a bottom plan view of the adapter shown in FIG. 11.

FIGS. 2, 5, and 6 illustrate a cord set that is designed to be permanently connected to the electrical connections on plate 32. This configuration is contemplated for use in the automotive aftermarket as well as industrial applications. FIGS. 7–12 illustrate a detachable cord set for use in the heavy duty markets. The detachable cord set shown in FIGS. 7–9 is designed to satisfy electrical connection requirements in North America whereas the detachable cord set shown in FIGS. 10–12 is configured for use in Europe. Those skilled in the art will appreciate from the following description, the claims, and the appended drawings that each of the modular cord sets shown and described herein include a generic portion that is disposable and compressible within receptacle 62 and that forms a double seal isolating connection chamber 40 from the environment surrounding tank heater 10.

With reference to FIG. 2, plug 66 of cord set 20 includes an application specific portion 70 integral with generic portion 72. A bore 73 (FIG. 5) extends through portions 70 and 72, such as from a first end face 95 to a second end face 97 of plug 66, thereby allowing use of continuous lead wires 39 having a first end 99 connectable to power source 19 and a second end 101 connectable to electrical connectors 31 of coil assembly 26 (FIG. 2). Generic portion 72 is configured to cooperate with inner surfaces 74 and 76 of sleeves 58 and 60 and, in the preferred embodiment as shown in FIG. 2, is a cylindrical body having a reduced diameter portion 94 and an enlarged portion 96 interconnected by an annular taper 98. Generic portion 72 is formed about an axis 100 and further includes an annular rib 102 integral with and extending radially outwardly from reduced diameter portion 94. A recess 104 (FIG. 5) extends radially inwardly from an outer surface 106 of enlarged portion 96 to cooperate with index tab 93 thereby ensuring proper positioning of plug 66 within receptacle 62.

Those skilled in the art will appreciate that during the assembly of tank heater 10, generic portion 72 of plug 66 is placed in operative engagement with sleeve 58 such that index tab 93 is disposed within recess 104 (FIG. 5). Terminal cap 24 is then coupled to basin 22 by a press fit operation whereby sleeves 58 and 60 cooperate to compress generic portion 72 of plug 66 within receptacle 62. Once assembled, annular rib 102 and grooves 92 cooperate to define inner seal 64. As best illustrated in FIG. 5, specific portion 70 of plug 66 preferably includes a ring flange 71 integral with generic portion 72 and cooperative with sleeves 58 and 60 so as to form outer seal 68. The resulting double seal arrangement provides excellent weather and dust protection for the electrical connection provided by lead wires 39 within electrical connection chamber 40.

In the preferred embodiment, terminal cap 24 and basin 22 are configured to include a coupling assembly for releasably yet lockingly coupling terminal cap 24 to basin 22 via a press fit operation. More particularly, as best illustrated in FIGS. 2 and 3, sleeve segment 58 of basin 22 includes diametrically opposed locking housings 108 and 110 each defining a longitudinal slot 112 communicating with a transverse slot 114 (FIG. 2). Locking housings 108 and 110 each further include a shoulder 116 defining a longitudinal face 118 (FIG. 3), partially defining longitudinal slot 112 and a locking face 120 (FIG. 2), and partially defining transverse slot 114.

With reference to FIGS. 2 and 4, the coupling assembly further includes a pair of tabs 122 and 124 integral with terminal cap 24, spaced from one another, and configured to cooperate with locking housings 108 and 110, respectively. More particularly, with reference to tab 122, each tab includes an arm 126 extending longitudinally from terminal cap 24 and a transverse nib 128 having an angled engagement face 130, a longitudinal face 132, and a transverse locking face 134 (FIG. 2).

Terminal cap 24 is preferably formed of a resilient material such as nylon. As a result, when angled engagement faces 130 of tabs 122 and 124 are placed in contacting engagement with longitudinal faces 118 of locking housings 108 and 110 and terminal cap 24 is urged longitudinally toward basin 22, tabs 122 and 124 are resiliently displaced transversely toward one another. Once cap 24 and basin 22 are fully urged together such that transverse nib 128 extends beyond shoulder 116, the resilient biasing force within tabs 122 and 124 urges the tabs transversely away from one another such that locking faces 134 operatively engage locking faces 120 of shoulders 116 to prevent inadvertent removal of terminal cap 24 from basin 22. This press fit engagement securely connects terminal cap 24 to basin 22 and compresses generic portion 72 of plug 66 within receptacle 62. Moreover, the snap-fit coupling of terminal cap 24 to basin 22 requires no special tools for assembly and disassembly during servicing or manufacturing.

As described above, first seal 64 is provided by the cooperative engagement of generic portion 72 within receptacle 62 while second seal 68 occurs such as along ring 71 of specific portion 70. Accordingly, the present invention provides a modular tank heater having a universal body and a variety of cord sets each with similarly configured generic plug portions and outer ring seals. In this regard, a variety of configurations of specific portion 70 of plug 66 are contemplated for use with the present invention, are shown in the drawings, and are described in detail below. However, those skilled in the art will appreciate that a multitude of alternative specific portions may be used with the present invention without departing from the proper scope of the invention as defined by the appended claims.

FIGS. 2, 5, and 6 illustrate two cord set embodiments that are adapted for use in the automotive aftermarket. That is, cord sets 20, 220 of FIGS. 2 and 5 and 6, respectively, are each designed to be permanently connected to the heater and to include a strain relief 79, 279 suitable for two common gages of both round and flat wire. More particularly, cord set 20 is shown in FIGS. 2 and 5 to include a strain relief 79 accommodating an SJ type cord which is used for hard usage type applications in construction or off road equipment and in applications where a double insulating jacket is required for safety reasons. While the present invention may be used with any one of the several SJ type cords, e.g., SJO, SJOW, and SJTW, due to market demands, the most frequently utilized SJ type cord is SJOW. FIG. 6 illustrates a similar cord set 220 used for a permanently connected cord set having a HPN cord 236 generally used in automotive and light duty applications where the power cord is protected by the vehicle. For simplicity, identical or similar elements of cord sets 20 and 220 are referred to with similar reference numerals.

As most clearly illustrated in FIGS. 2 and 6, the respective specific portions 70 and 270 of plugs 66 and 266 each include a lower flange 71 and 271, respectively, integral with and extending radially outward from enlarged portion 82 and strain reliefs 79, 279, respectively, integral with flange 71, 271. Strain reliefs 79 and 279 partially define bores 73 (FIG. 5) for accommodating lead wires 39. Those skilled in the art will appreciate that strain reliefs 79 and 279 prebend lead wires 39 such as at a ninety degree (90°) angle, to facilitate proper mounting of the cord set.

As illustrated in FIGS. 5 and 6, external flanges 71 and 271 include an annular face 81 and 281, respectively, that contacts a lower and preferably circular surface 83 (FIGS. 3 and 4) of sleeves 58 and 60 to define outer seal 68 between plug 66 and heater body 21. Accordingly, a single tank body 21 can be used with plugs 66 and 266 to define a double seal connection in receptacle 62 between the plug and tank body thereby providing a modular power connection with excellent weather and dust protection for connection chamber 40.

The modular electrical connection provided by the present invention is further enhanced by the use of an adapter that allows a single power cord to sequentially connect numerous heaters to a single power source. Alternative configurations for the adapter are shown with reference to cord sets 320 and 420 of FIGS. 7–12. While each of the adapters include generic portion 72, they also include terminalizations for accepting a cord set plug. The adapters are specifically designed to meet the market demand in the heavy duty industries while complying with the electrical requirements in Europe and North America. More particularly, FIGS. 7–9 illustrate an adapter satisfying the North American requirements whereas FIGS. 10–12 illustrate and adapter allowing use of body 21 in Europe. Finally, cord sets 320 and 420 illustrated in FIGS. 7–12 each include grounding arrangements described in detail below as well as non-interchangeable features intended to eliminate the possibility of connecting a heater to an incorrect power supply.

FIGS. 7–9 illustrates a cord set 320 designed for detachable connection to tank heater 10 for use in the heavy duty vehicle market such as for installation on large trucks, agricultural equipment, construction vehicles, and the like. Detachable cord set 320 includes a cord adapter 366 having generic portion 72 that is substantially the same as that described above in relation to FIGS. 2 and 5, for sealably coupling adapter 366 within receptacle 62. Just as with generic portion 72 of plug 66, adapter 366 includes an indexing slot 304 (FIG. 8) in an enlarged diameter portion 396 to accommodate index tab 93 and thereby ensure proper orientation of adapter 366 within receptacle 62.

As best seen in FIGS. 8 and 9, adapter 366 also includes an inner surface 340 having a circular portion 342 and a planar portion 344. An end wall 346 cooperates with inner surface 340 to define a cavity 348 communicating with index slot 304 while apertures 350 extend axially through reduced diameter portion 394 of cord adapter 366 to accommodate lead wires 39 that terminate at pins 378. As shown in FIGS. 8 and 9, pins 378 extend into cavity 348 from end wall 346.

Cord set 320 further includes a cord 352 defining a head 354 having a circular segment 356 and a planar segment 358 configured for disposal within cavity 348. Head 354 further includes a grounding strap 360 extending longitudinally along circular segment 356 so as to lie within the area of recess 304. A pair of barrel connectors 380 are also provided in head 354 so that when cord 352 is fully connected to adapter 366, strap 360 contacts index tab 93 of sleeve 58 and barrel connectors 380 accommodate and are electrically connected to pins 378.

Finally, in the preferred embodiment, cord 352 includes an internally threaded ring 362 that cooperates with external threads 364 on adapter 366 to removably yet securely couple cord 352 to adapter 366. Ring 362 defines an annular seal surface 381 that contacts outer surface 83 of sleeves 58 and 60 to form second seal 68 as described above.

In another embodiment of the present invention illustrated in FIGS. 10–12, cord set 420 includes an adapter 466 configured to comply with the electrical requirements in European markets. Adapter 466 again includes a generic portion 72 cooperative with receptacle 62 as well as a specific portion 470 that is adapted for use in European industrial markets. More particularly, specific portion 470 includes a generally tubular cylindrical projection 473 integral with generic portion 72 and defining a cylindrical inner surface 474 (FIG. 12) having indexing protrusions such as wedges 476 extending therefrom to ensure proper orientation of the cord head 454 for connection thereto. A plurality of terminals including power pins 478 and a ground pin 479 (FIG. 12) extend longitudinally from an end face 480 and into a cavity 448. Finally, adapter 466 is illustrated to include a ring 471 extending radially from specific portion 470 to cooperate with sleeves 58 and 60 to form outer seal 68 therebetween in a manner similar to ring flange 71 shown in FIG. 5.

The proper orientation of adapter 466, cord head 454, and receptacle 66 is further ensured by the presence of index slot 404 in the enlarged diameter portion 496 of generic portion 72 as well as opening 405 in generally tubular cylindrical projection 473. Index slot 404, in the embodiment shown in FIGS. 10–12, is a blind slot that cooperates with tab 93 (FIGS. 3 and 5) to ensure proper orientation of adapter 466 within receptacle 62. In a similar fashion, slot 405 formed in cylindrical projection 473 accommodates a tab 407 projecting radially from head 454 to further ensure the proper positioning of head 454 within cavity 448.

As alluded to above, cord set 420 includes a cord 452 having head 454 configured for cooperation with specific portion 470 of adapter 466 to electrically connect cord 436 to wires 39. Head 454 includes a pair of power barrel connectors 481 and a ground barrel connector 483 extending inwardly from an end face 485. Those skilled in the art will appreciate that ground and power barrel connectors are electrically connected to power cord 436 and arranged within head 454 to accommodate pins 478 and 479 (FIG. 12) for electrical connection of power cord 436 to wires 39.

The configuration of head 454 ensures its proper positioning relative to adapter 466 prior to connection of pins 478 and 479 to barrel connectors 481 and 483, respectively. Specifically, head 454 includes a generally cylindrical longitudinal projection 455 defining end face 485 and including wedge shaped notches 487 cooperative with protrusions 476 and a generally planar chordal surface 489 with a semicircular projection 491 cooperative with chordal projection 477 and semicircular recess 482 of adapter 466 (FIG. 12).

The modularity provided by the present invention will be apparent to those skilled in the art based on the above description of cord sets 20, 220, 320, and 420 each of which are specifically designed for use in particular markets. As generally described above, the modular design of receptacle 62 and the cord sets allows a single tank heater configuration to be used in the North American and European markets as well as in automotive, heavy duty, and industrial applications. Further advantages provided by the present invention include: the snap or press fit design of the terminal cap 24 and basin 22 connection facilitates assembly and disassembly of the heater element which is particularly advantageous for servicing and manufacturing of the unit; the double seal design provided by the internal rib and external flange configuration of the respective plugs and adapters provides excellent weather and dust protection; and the non-interchangeable features of the adapters virtually eliminates the possibility of connecting a heater to an incorrect power supply.

The modularity of the tank heater 10 is further enhanced by mounting assembly 23. Mounting assembly 23 provides mounting flexibility to suit different requirements in the geographic and vehicular markets discussed above while also maintaining structural strength as well as ease of installation and removal. More particularly, mounting assembly 23 provides a large vertical range of installation locations in that the brackets of the assembly, as hereinafter described, can be mounted at the top or bottom of the heater body. Additionally, the design symmetry of the mounting assembly affords multiple directions of bracket and heater orientation. It should be appreciated that the mounting flexibility provided by assembly 23 is particularly desirable in view of the multiple applications of tank heater 10.

As best seen in FIG. 2, mounting assembly 23 is a multi-point mounting system wherein basin 22 defines a plurality of mounting elements 512 each of which are removably connectable to a bracket 514. Mounting elements 512 are located proximate to a top 22*a* and bottom 22*b* of basin 22 such as at each of the four corners of basin 22. Brackets 514 are each removably connectable to a selected two of the mounting elements via a threaded bolt 516, lock washer 518, and nut 520. Selective coupling of brackets 514 to mounting elements 512 allows right side mounting (FIG. 2), left side mounting (not shown), top mounting (FIG. 6), or bottom mounting (FIG. 7) of basin 22 to a vehicle such as the light duty truck shown in FIG. 1 or other structure.

In the preferred embodiment of the present invention, as is most clearly illustrated in FIG. 2, mounting posts 512 define a socket having a rectangular cavity configured to accommodate and capture nut 520. Cavity 524 is bounded by a pair of side walls 526, a top wall 528, and a bottom wall 530. The top and bottom walls each include an arch shaped recess 532 to facilitate the insertion of bolts 516. Additionally, it is specifically contemplated that each cavity 524 is configured to accommodate and rotatably restrain a one-quarter (¼) inch hex nut that is included with tank heater 10. As a result of this arrangement, one of the operator's hands remains free to aid in the positioning of the heater during installation. Moreover, the nut capture feature of mounting assembly 23 avoids problems associated with casting or otherwise forming a threaded hole in basin 22 such as compromising of the cooling chamber due to cracking of the casting caused by over-tightening of the bolts as well as galvanic corrosion and seizing between the bolts and threaded holes that could also lead to damage of the casting. Those skilled in the art will appreciate that a variety of socket and nut sizes and shapes may be used with the present invention without departing from the scope of the invention as defined by the appended claims.

Brackets 514 are preferably L-shaped to include a short leg 534 and a long leg 536 each of which define an aperture 538 sized to accommodate bolts 516. While short leg 534 is illustrated in FIG. 2 to be connected to mounting posts 512, those skilled in the art will appreciate that the orientation of the brackets may be varied to select the proper tank offset from the body to which the tank is connected such as by coupling long leg 536 to mounting posts 512. For example, long leg 536 may be connected to mounting posts 512 as illustrated in FIG. 7.

From the above description as well as the appended claims and drawings, those skilled in the art will recognize that the modular features of the present invention relating both to the electrical connection of the tank heater to a power source as well as the mounting of the tank body to a structure provides a unique degree of flexibility over the teachings of the prior art. The modularity of the present invention will decrease costs associated with manufacturing and supplying tank heaters for various applications. Additionally, the unique seal arrangement provided by the receptacle and plug configuration of the present invention more effectively isolates the electrical connections within the tank heater from the surrounding environment thereby increasing the service life of the tank heater.

Various other advantages of the present invention will become apparent to those skilled in the art after having the benefit of studying the foregoing text and the appended drawings, taken in construction with the following claims:

What is claimed is:

1. A modular tank heater apparatus comprising:

a housing defining a cavity and a receptacle, communicating with said cavity, said receptacle having an inner surface and an end face;

a heater element coupled to said housing and communicating with said cavity; and a cord set having a first end connectable to said heating element and a second end connectable to a power source, said cord set being selectable from one of a first cord set for providing a permanent electrical connection between said first and second ends of said cord set and a second cord set for providing a removable electrical connection between said first and second ends of said cord set such that said heating element is permanently or removably connectable to said second end of said cord set by selecting and coupling one of said first and second cord sets to said heating element, said first cord set including a plug having a generic plug portion disposable in said receptacle to create a first seal between said plug and said inner surface of said receptacle, said plug of said first cord set further including a specific plug portion having a flange integral with said generic plug portion, said flange engageable with said end face of said receptacle to create a second seal between said plug and said receptacle, and said second cord set including a plug having a generic plug portion disposable in said receptacle to create a first seal between said plug and said inner surface of said receptacle, said plug of said second cord set further including a specific plug portion having a sleeve, a cord head, and second sealing means for engaging said end face of said receptacle to create a second seal between said plug and said receptacle, said sleeve being integral with said generic portion and having an inner surface defining a cavity, said cord head disposable in said cavity to electrically connect said heating element to said power source.

2. The apparatus of claim 1 wherein said generic portion of each plug includes a first cylindrical portion, a second cylindrical portion integral with said first cylindrical portion, a first arcuate segment interconnecting said first and second cylindrical portions, and an annular rib projecting from said first cylindrical portion, and wherein said receptacle includes an outwardly extending groove, said annular rib engageable with said groove to define said first seal.

3. The apparatus of claim 1 wherein said first cord set further includes a stress relief integral with said specific portion of said plug.

4. The apparatus of claim 1 wherein said specific portion of said second cord set further includes tabs projecting from said inner surface into said cavity, and wherein said head includes an outer surface configured to cooperate with said tabs to orient said head within said blind bore.

5. The apparatus of claim 1 wherein said second sealing means of said second cord set includes an internally threaded connector ring, external threads formed on said specific portion of said plug, said connector ring having a seal face engageable with said end face of said receptacle to create said second seal between said receptacle and said plug.

6. The apparatus of claim 1 further including an index cavity in each of said generic portions of said plugs and an annular indexing tab extending into said receptacle and disposable in said index cavities to orient said plugs of said first and second cord sets relative to said receptacle.

7. The apparatus of claim 6 wherein said housing includes a first member, a second member, slots formed in one of said first member and said second member, and flexible tabs extending from the other of said first member and said second member, said tabs disposable within said slots to releasably couple said first member to said second member.

8. The apparatus of claim 1 further including a plurality of mounting elements integral with said housing, a first bracket and a second bracket each having a first end and a second end, coupling means for selectively coupling said first end of said first bracket to one of said plurality of mounting elements, said second end of said first bracket to a body, said first end of said second bracket to another one of said plurality of mounting elements, and said second end of said second bracket to the body whereby said housing is selectively connectable in a variety of positions relative to the body.

9. The apparatus of claim 8 wherein said housing includes a top and a bottom, two mounting elements integral with said housing proximate to said top, and two mounting elements integral with said housing proximate to said bottom.

10. The apparatus of claim 8 wherein each of said mounting elements include a top wall, bottom wall, and a pair of side walls defining a nut capture socket, and wherein said coupling means includes a threaded nut disposable in said nut capture socket and a threaded bolt engageable with said nut, said side walls of said mounting element limiting rotational movement of said nut when said nut is within said nut capture socket.

11. A method of manufacturing a modular tank heater comprising the steps of:

manufacturing a housing that includes a cavity and a receptacle, said receptacle communicating with said cavity, said receptacle having an inner surface and an end face;

coupling an electric heating element to said housing; and connecting a cord set to said heating element, said cord set having a first end connectable to said heating element, said cord set including at least one of (a) a first cord set for providing a permanent electrical connection to said heating element, said first cord set including a plug having a generic plug portion disposable in said receptacle to create a first seal between said plug and said inner surface of said receptacle, said plug of said first cord set further including a specific plug portion having a flange integral with said generic plug portion, said flange engageable with said end face of said receptacle to create a second seal between said plug and said receptacle, and (b) a second cord set including a plug having a generic plug portion disposable in said receptacle to create a first seal between said plug and said inner surface of said receptacle, said plug of said second cord set further including a specific plug portion having a sleeve, a cord head, and second sealing means for engaging said end face of said receptacle to create a second seal between said plug and said receptacle, said sleeve being integral with said generic portion and having an inner surface defining a cavity, said cord head disposable in said cavity to electrically connect said heating element to said power source whereby said heating element is permanently or removably connectable to said second end of said cord set by selecting and coupling one of said first and second cord sets to said heating element and said plug to said receptacle.

12. The method of claim 11 wherein the step of manufacturing a housing includes casting a basin having a first receptacle sleeve and forming a cover having a second receptacle sleeve, said cover connectable to said basin such that said first and second receptacle sleeves cooperate to form said receptacle, said receptacle including a groove, and wherein said generic plug portions each include a rib engageable with said groove to form said first seal.

13. The method of claim 12 wherein said first and second cord sets include a flange engageable with said housing to form said second seal.

14. An electrically powered apparatus comprising:

a housing defining a cavity and a receptacle communication with said cavity, said receptacle having an inner surface and an end face;

an electrically powered element couple to said housing; and a cord assembly including a first cord end connectable to said electrically powered apparatus and a second cord end electrically connectable to a power source, said cord assembly including a plug engaging said receptacle to create a first seal along said inner surface of said receptacle and a second seal at said end face of said receptacle and wherein said cord assembly is selected from one of a first cord set for permanently electrically interconnecting said first and second cord ends and to create said first and second seals and a second cord set for releasably electrically interconnecting said first and second cord ends and to create said first and second seals, each of said first and second cord sets including a generic plug portion disposable in said receptacle to create said first seal.

15. The apparatus of claim 14 wherein said receptacle includes a groove extending outwardly from said interior surface, wherein said plug includes a generic portion having a rib, said rib engaging said groove to form said first seal.

16. The apparatus of claim 14 wherein said plug includes a flange engaging said end face to form said second seal.

17. The electrically powered apparatus of claim 14 wherein said second cord set includes an adapter defining said generic plug portion and including a bore, said second cord set further including a head electrically connected to said second cord end and adapted to be disposed in said bore to release couple said head to said adapter and to releasably electrically connect said first cord end to said second cord end.

18. The electrically powered apparatus of claim 17 wherein said second cord set includes a flange and a sleeve extending from said flange, said sleeve defining said bore, said flange adapted to engage said end face to create said second seal when said head is disposed in said bore.

19. The electrically powered apparatus of claim 17 wherein said cord assembly is further selectable from a third cord set for releasably electrically interconnecting said first and second cord ends and to create said first and second seals, said third cord set including an adapter defining said generic plug portion of said third cord set, said adapter of said third cord set includes a bore, said third cord set further including a head electrically connected to said second cord end and adapted be disposed in said bore to releasably couple said head to said adapter of said third cord set and to releasably electrically connect said first cord end to said second cord end, said head of said third cord set being configured to prevent connection of said head of said third cord set to said bore of said second cord set and said head of said second cord set being configured to prevent connection of said head of said second cord set to said bore of said third cord set.

20. The electrically powered apparatus of claim 19 wherein said housing includes a tab within said receptacle, wherein said third cord set includes a passage communicating with said bore and an electrically conductive grounding strap electrically connected to said second cord end and coupled to said head of said third cord set, and wherein said tab is disposable in said passage and said head is disposable in said bore to place said grounding strap in electrical connection with said tab.

* * * * *